US006076306A

United States Patent [19]

Victor et al.

[11] Patent Number: 6,076,306

[45] **Date of Patent: *Jun. 20, 2000**

[54] RAILING SYSTEM FOR TELESCOPIC SEATING

[75] Inventors: Daniel R. Victor, Kalamazoo; Stanley W. McKay, Richland; Melvin J. Guiles, Casnovia; Kenneth A. Ahrens, Schoolcraft, all of Mich.

[73] Assignee: Interkal, Inc., Kalamazoo, Mich.

[ * ] Notice: This patent is subject to a terminal disclaimer.

[21] Appl. No.: 09/019,308

[22] Filed: Feb. 5, 1998

Related U.S. Application Data

[63] Continuation of application No. 08/704,493, Aug. 20, 1996, Pat. No. 5,813,663.

[51] Int. Cl.[7] ..... E04H 3/12; E04H 17/00

[52] U.S. Cl. ..... 52/9; 256/1; 256/59; 256/DIG. 6

[58] Field of Search ..... 256/59, 65, 68, 256/1, DIG. 5; 52/8, 9; 135/65, 66, 68, 67, 71, 72, 73; 192/106, 113

[56] References Cited

U.S. PATENT DOCUMENTS

| | | | |
|---|---|---|---|
| 3,920,221 | 11/1975 | Berry et al. | 256/59 |
| 3,964,215 | 6/1976 | Hartman et al. | 52/9 |
| 4,006,564 | 2/1977 | Wiese | 52/9 |
| 4,014,522 | 3/1977 | Sutter | 52/9 X |
| 4,014,523 | 3/1977 | Reader | 256/59 |
| 4,571,895 | 2/1986 | Lyman, Jr. | 256/59 X |
| 5,384,927 | 1/1995 | Mardero et al. | 403/4 X |
| 5,813,663 | 9/1998 | Victor et al. | 256/59 |
| 5,820,110 | 10/1998 | Beu | 256/59 |

*Primary Examiner*—Harry C. Kim
*Attorney, Agent, or Firm*—Baker & McKenzie

[57] ABSTRACT

A railing system for a telescopic seating arrangement, such as bleacher systems and platform seating systems. The railing system includes discrete lightweight and readily stowable uprights, each having a single closed-loop upper section. Brackets carried by the nose of decks receive a plate affixed to the lower end of each upright. The brackets which support the uprights have a low profile so that the seating system is readily useable if the uprights are not installed. The lightweight and easily stowed uprights of this railing system eliminate the factors which lead to use of a seating system without handrails.

7 Claims, 3 Drawing Sheets

FIG. 1
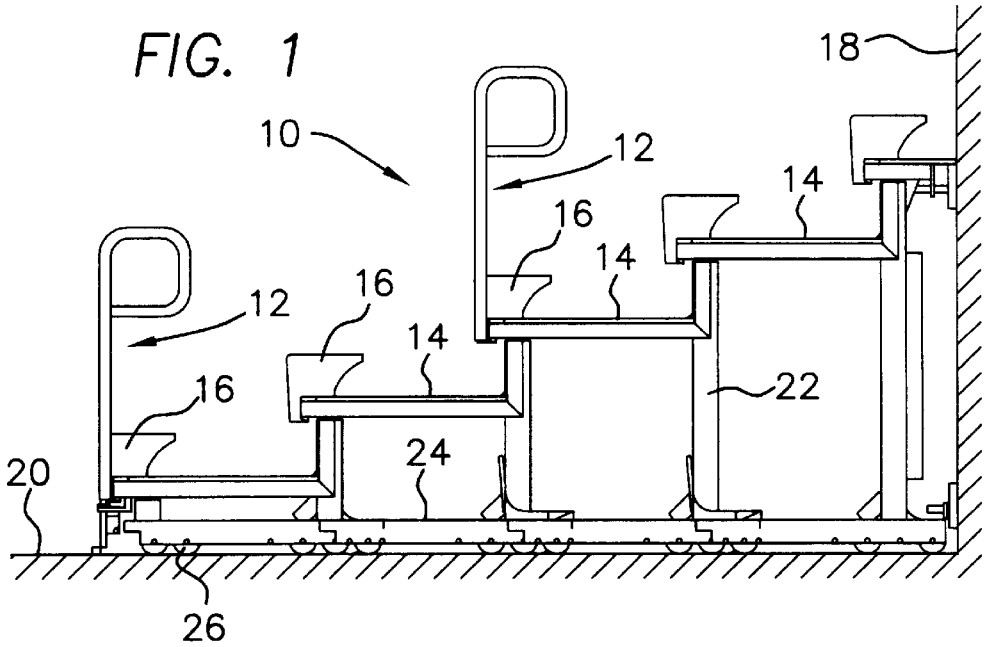
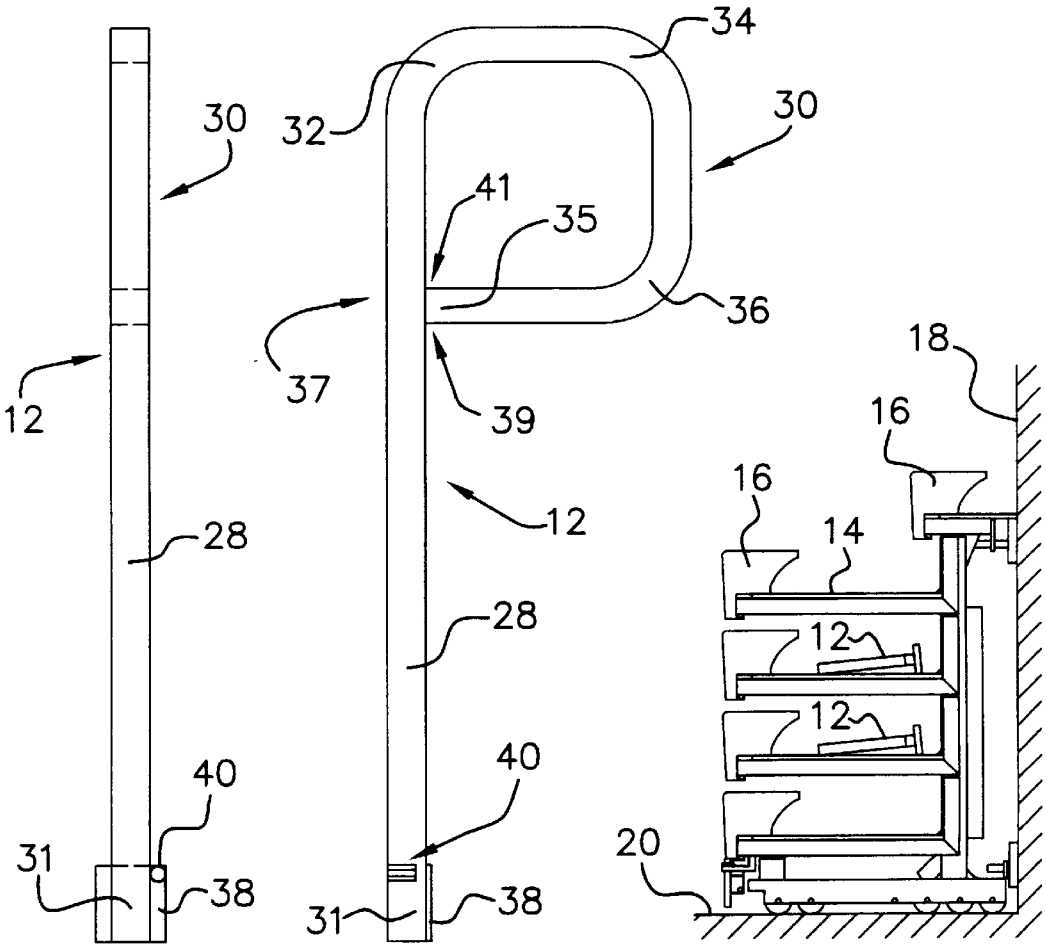
FIG. 4 FIG. 3 FIG. 2

RAILING SYSTEM FOR TELESCOPIC SEATING

This is a continuation of application Ser. No. 08/704,493, which was filed on Aug. 20, 1996, now U.S. Pat. No. 5,813,663.

BACKGROUND AND SUMMARY OF THE INVENTION

The present invention relates generally to hand railings for bleachers, platform seating and other telescopic seating arrangements. More particularly, the invention relates to a system of handrails which can be mounted to, removed from, and stored within a telescopic seating assembly.

Hand railing systems for bleachers are generally well-known in the prior art. Examples of such systems can be found in U.S. Pat. such as No. 4,361,991 (Wiese) and U.S. Pat. No. 4,014,522 (Sutter) wherein a sloping upper rail is supported by a plurality of support members extending downwardly from the rail into supports mounted to the underlying telescopic structure.

Other more complex systems are shown in U.S. Pat. No. 4,997,165 (Wiese), U.S. Pat. No. 3,788,608 (Raymond et al), and U.S. Pat. No. 3,401,918 (Wiese), where the railings include multiple hinges and multiple interconnected and moveable parts.

U.S. Pat. No. 4,014,523 (Reader) shows simple handrails, but in the context of fixed stadium seats. This railing has a plurality of vertical supports attached at multiple locations to a stadium chair at the end of a row of stadium seats.

In telescopic seating systems, there is generally a requirement that the railing be removable from its use position in order for the seating to telescope from the extended position, in which the rows of seating are accessible, to a retracted position, in which the seating assembly occupies a minimum of floor space. Installation and storage of the railings can present problems, especially if hinges are precluded or eliminated from the design, as they often are because of their tendency to snag. The *Life Safety Code Handbook* (1994) at Section 5-2-2.4.4 suggests that handrails have "no projections that might engage loose clothing." Large handrails which cannot be stored on or near the seating assembly may need to be carried longer distances, by multiple workers. Even if storage is near the location where the seating will be used, assembly of large unhinged rails can be difficult because of alignment problems resulting from large tolerances present in telescopic seating systems. Large and/or complex handrail assemblies are also a problem in that they are heavy and, if dropped, can damage the seating assembly itself or a gymnasium floor. Large or complex handrail assemblies are generally difficult to handle and install and, as a result, installation may be postponed or avoided if a shortage of personnel or time should arise.

In instances where a railing does not get installed, either because of a remote storage location or because of a complex assembly, a second hazard emerges, in addition to the absence of a handrail: the hardware used to support the missing handrail can itself be a tripping hazard. This is particularly true of systems which are intended to be installed down the center of an aisle.

The present invention solves many of the problems associated with prior art handrail systems used in telescopic seating assemblies. The railing system of the present invention can be easily handled by one person, and its installation is not dependent upon or otherwise complicated by variance in the alignment of sections of the telescopic assembly to which it is mounted. The components of the system of the present invention may be readily stored within the seating assembly with which it is used. In addition, the railing system of the present invention meets all code requirements regarding spacing and the absence of snag and tripping hazards.

The invention can be summarized, with reference to a preferred embodiment, as a series of independently supported uprights mounted to the decks of a telescopic seating assembly. Each upright has a single elongated base segment to which is mounted a plate which fits into a support socket afixed to the nose of a deck. A curved section comprised of a series of bent sections extends upwardly and at angles from a base segment to form a closed loop which may be readily grasped by spectators entering and leaving the seating assembly.

The objects and advantages of the present invention will become apparent from the following detailed description, when read in conjunction with the accompanying drawings which show some preferred embodiments of the invention. It will be recognized by persons skilled in the art, however, that the drawings and the embodiments shown and described herein are for purposes of illustration and are not intended to preclude other versions, modifications, variations or improvements from coming within the scope of the invention as set forth in the claims.

BRIEF DESCRIPTION OF THE DRAWINGS

For a detailed description of the preferred embodiment of the present invention, references should be made to the accompanying drawings wherein:

FIG. 1 is a side elevational view of a telescopic seating assembly in an extended position showing uprights of the present invention in their installed position.

FIG. 2 is a side elevational view of the assembly of FIG. 1 in the retracted position and the uprights in a stowed position.

FIGS. 3 and 4 are side and front elevational views, respectively, of an upright of the present invention.

DETAILED DESCRIPTION OF THE INVENTION

Figure 5:
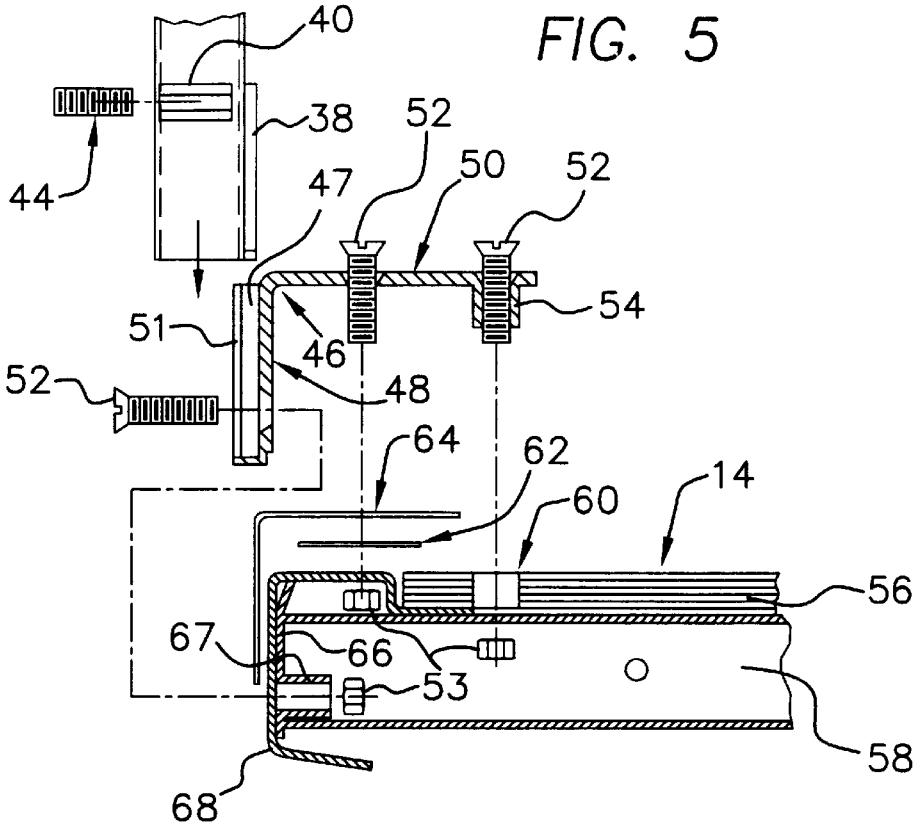
FIG. 5 is an exploded side view of the connection used to support the components of a railing system of the present invention.
Figure 6:
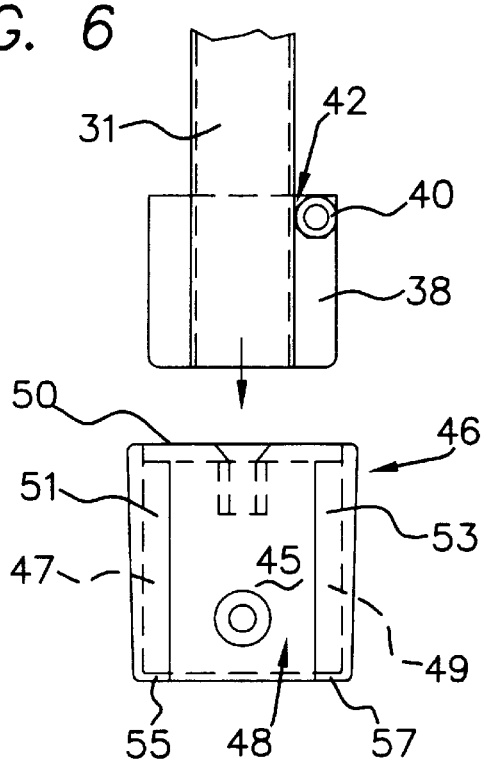
FIG. 6 is an enlarged exploded front view of the lower end of an upright about to be inserted into a socket in the system of the present invention.

FIGS. 1 and 2 show a bleacher assembly 10 with a handrail system comprised of uprights 12 affixed to the decks 14 of the assembly 10. As with most bleacher systems, the bleacher assembly 10 includes bleacher seats 16 supported by decks 14. The decks 14 are supported by vertical framework 22 and horizontal framework 24 to facilitate movement of the assembly to and from the extended position (shown in FIG. 1) and the retracted position (shown in FIG. 2).

FIG. 2 shows the uprights 12 removed from their supports (see FIG. 5) and stored in the space behind the bleacher seats 16.

FIGS. 3 and 4 show an upright 12 in more detail. Each upright is comprised of a vertically oriented (when installed) base segment 28. In the version shown here, a tubular metal of generally squared-off cross-section was used, but a rounded or other cross-sectional shape could be used for aesthetic or other reasons.

The upright 12 has a curved upper section 30 comprised of a first bent portion 32 which defines an angle of about 90 degrees in the clockwise direction as shown in FIG. 3. A second bent portion 34 extends from the first bent portion 32, and also defines a 90 degree angle continuing in the clockwise direction. Finally, the loop created by the curved upper section 30 is completed by a third bent portion 36, also bent in a 90 degree angle, which brings the upper end 35 of the tube used to form the upright back to a position which is adjacent to the upper end of the base segment 38 at a junction 37.

Pin opening or notch 39 is formed on the lower part of the end of the tube which is adjacent to the upper part of the base segment 28. The purpose of the notch is to allow drainage of liquids used in finishing processes. A weld 41 is used to connect the upper edge of the upper end 35 to a side surface of the base segment 28. The upright is preferably made of 1.5 inch 14 gauge steel tube stock.

At the lower end 31 of the upright 12, a flat plate 38 is welded to the rear face of the base segment 28. Perpendicular to the plate 38, a nut 40 is welded to the lower end 31 of the base segment. As is explained below, the nut 40 is internally threaded so as to receive a set screw 44 (see FIG. 5) used to lock the upright in place.

FIG. 5 shows the details of a structure used to support an upright of the present invention. A deck 14 is comprised of plywood flooring 56 carried by horizontally disposed metal subflooring channels 58. The nose of the deck includes a nosebeam 68 which covers a nose plate 66 disposed at the end of the channel 58. A standoff 67 is welded to the lower portion of the channel 58.

A bracket 46, including a horizontal flange 50 and a vertical flange 45 is attached to the metal subfloor channel 58, to the nose plate 66, and to the nose beam 68 by three bolts 52. The bolts 52 all have countersunk heads which fit into countersunk holes in the bracket 46 so as to minimize the tripping and snag hazard associated with the support hardware for the uprights, in the event that the seating assembly is used with the uprights having been installed. The tripping hazard is further minimized by the fact that the bracket 46 wraps neatly around the nose of the deck 14 and projects only slightly upwardly from the upper surface of the deck and slightly forward beyond the nose of the deck. The standoff 54 fits into a hole 60 in the plywood flooring 56.

The plate 38 which is welded to the lower end 31 fits into slots 47 and 49. The slots 47 and 49 defining a socket 48 are bounded by the vertical flange 45, cover plates 51 and 53, and small end plates 55 and 57. When the bottom edge of the plate 38 abuts the end plates 51 and 53, the set screw 44, preferably a hex socket type, may be used to hold the upright in place by holding the plate 38 within slots 47 and 49 which form the socket 48.

To ensure that the step formed by the deck 14 is readily visible, a black contrasting tread is placed on the upper corner of the nose beam 68 covering the upper surface of the nose beam 68 and a forward portion of the plywood flooring 56. A strip of mylar tape 62 is placed between the tread 64 and the nose beam 68 to cover perforations in the top surface of the nose beam 68.

Figure 7:
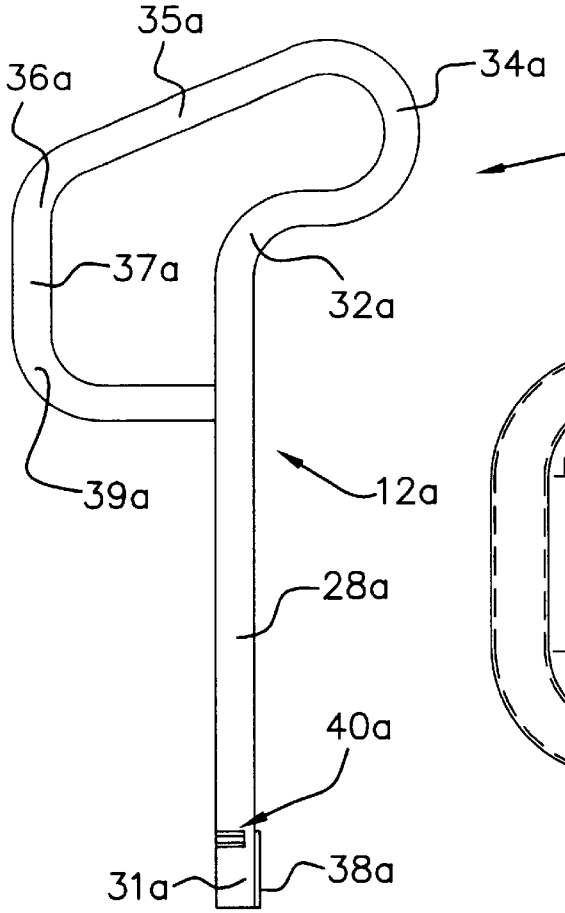
FIG. 7 is a side elevational view of an alternative preferred embodiment of an upright made for use in practicing the present invention.
Figure 8:
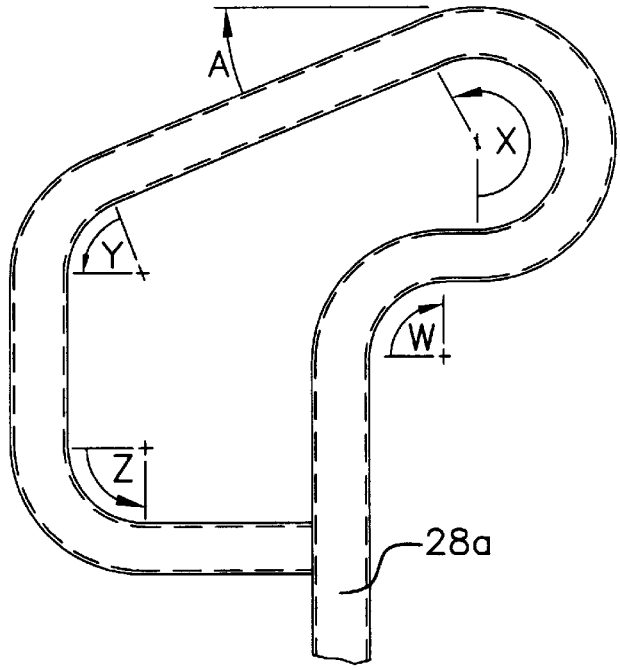
FIG. 8 is an enlarged view of the curved upper section of the upright shown in FIG. 7.

FIGS. 7 and 8 show an alternative preferred embodiment of the upright 12*a* used in the railing system of the present invention. In this embodiment, the lower end 31*a* is the same as the lower end 31 described above with reference to FIGS. 3, 4 and 5. Throughout FIGS. 7 and 8, the suffix "*a*" is included in the reference numerals to differentiate the embodiment of these figures from the earlier described upright 12 shown in FIGS. 3, 4 and 5. However, where similar structural components appear, the same numerical portion of the reference numeral is used.

The curved upper portion 30*a* is comprised of a first bent portion 32*a* bent in a clockwise direction about 90 degrees (Angle W). A second bent portion 34*a* extends substantially immediately from the first bent portion 32*a*. The second bent portion 34*a* defines a counterclockwise angle in excess of 180 degrees and leads to a straight portion 35*a*, which is disposed at an angle A, which should be approximately equal to the incline defined by the seating of the system with which the upright is to be used. In the example shown in FIGS. 7 and 8, the second bent portion 34*a* defines an angle of 204 degrees, which will result in the straight portion 35*a* being disposed at an angle (A) of 24 degrees with respect to horizontal, if angle W is 90 degrees and the base element 28*a* is vertical.

A third bent portion 36*a*, connected by straight section 35*a* to the second bent portion 34*a*, defines an angle Y, which in this example is about 66 degrees. A straight section 37*a* and a 90 degree forth bent portion 39*a* completes the loop defined by the upper curved section 30*a*. The result of the combination of the bent and straight sections is a shape that reassembles a pelican's head. This shape extends the curved upper portion along the line defined by the incline of the rows of seating and enables the railing to meet the spacing requirements of most, if not all, relevant building codes, while at the same time allowing easy installation and storage of the uprights. All current U.S. building codes require that handrails be designed to carry a force of 200 pounds applied at any point and in any direction along the top curved section of the rail. Lateral extensions of the top curved portion in both directions relative to the base segment 28*a* in FIG. 7, as opposed to extension in only one direction as shown in FIG. 3, minimizes the torsional force which must be carried by both the base segment and the socket shown in FIG. 5. For rails of equal horizontally projected width, the "pelican head" design rail would carry and transmit about ½ the torsional force due to its load balancing design. Thus, thinner, lighter materials may be used."

Figure 9:
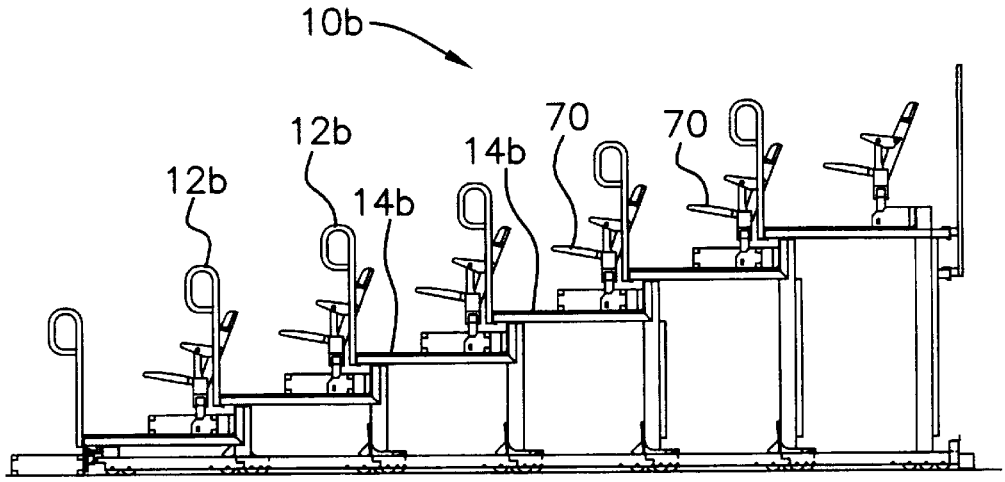
FIG. 9 is a side elevational view of a railing system of the present invention as utilized on a telescopic platform seating assembly.

FIGS. 1 and 2 show a railing system for a telescopic bleacher assembly. FIG. 9, however, shows that the same components, i.e. uprights and associated support hardware as described above, may be used on a system which uses platforms seating 70 of the type in which seating with folding backs, arms and seats pivot into a horizontal or other stored position. The is uprights 12*b* shown in FIG. 9 are supported on the decks 14*b* by the same support components as are shown in FIG. 5.

When the platform seating assembly 10*b* is ready to be put into a retracted position, a single person can loosen the se t screws used to hold the uprights 12*b* in place, remove the uprights 12*b* from their supports and lay them in a horizontal position on the decks 14*b*, at the location of a step in an aisle in the assembly, without any resulting interferences with the ability of the seats 70 of platform seating to fold downward into their stowed positions.

While specific embodiments of the invention have been shown and described, it will be apparent to those skilled in the art that numerous alternatives, modifications, and variations of the embodiment shown can be made without departing from the spirit and scope of the appended claims.

I claim:

1. A telescopic seating construction comprising rows of seating and at least one aisle for allowing users to gain access to the rows of seating, each of the aisles including at least one step with a nose, and a hand rail system including at least one upright disposed in at least one of the aisles and an upright support mounted adjacent to the nose of said at least one step in the aisle, said support having an opening to receive a lower end of said upright, the upright comprising a single base section, and a curved upper section having at least one bend, the base section and the curved upper section being made from a single piece of elongated material, the piece of elongated material being bent in a single clockwise direction, a lower first end of the piece of elongated material terminating at a lower end of the base section, and an opposite upper end of the piece of elongated material terminating at an elevation corresponding to an upper part of the base section away from the first end, the opposite end being attached directly to the base section at a location away from the first end, said upright being removable from said support and stowable between said rows of seating when said seating is in a retracted position.

2. A telescopic seating construction in accordance with claim 1 wherein said upright support includes a socket shaped to receive and surround a portion of said lower end of said upright, and means for securing said lower end in said socket.

3. A telescopic seating construction in accordance with claim 1 including a plate carried by the lower end of the base section of the upright; and a socket for slideably receiving the plate, the socket being mountable to a front portion of the nose of the step, the plate fitting tightly in the socket such that the upright may be supported on the step.

4. A telescopic seating construction in accordance with claim 3, further including:

a nut affixed to the lower end of the base section of the upright, and a bolt threadable into the nut, the nut being aligned so that the bolt will extend through the nut and be tightenable against the socket.

5. A telescopic seating system comprising rows of seating which may be moved from an extended position, in which the rows may be occupied, to a stowed position, in which the rows are stacked and stowed, and the telescopic seating system further including at least one aisle for allowing users to gain access to the rows of seating, each of the aisles including at least one step with a nose, and a hand rail system including at least one upright disposed in at least one of the aisles and mounted adjacent to the nose of at least one of the steps in the aisle and being held by a support carried by said at least one step, said support having a socket shaped to receive and surround a lower portion of said upright, the upright comprising a curved upper section having at least one bend, a base section and the curved upper section being made from a single piece of elongated material, the piece of elongated material being bent in a single clockwise direction, a lower first end of the piece of elongated material terminating at a lower end of the base section, and an opposite upper end of the piece of elongated material terminating at an elevation corresponding to an upper part of the base section away from the first end, the opposite end being attached directly to the base section at a location away from the first end, said lower portion of said upright being removable from said support, and said upright having a lateral dimension whereby it may be stowed between said rows of seating without interfering with movement of said telescopic seating system to its stowed position.

6. A telescopic seating system in accordance with claim 5 including:

a plate carried by the lower end of the base section of the upright;

said socket slideably receiving the plate, the socket being mountable to a front portion of the nose of the step, the plate fitting tightly in the socket such that the upright may be supported on the step.

7. A telescopic seating system in accordance with claim 6 including:

a nut affixed to the lower end of the base section of the upright, and a bolt threadable into the nut, the nut being aligned so that the bolt will extend through the nut and be tightenable against the socket.

* * * * *